US010292519B1

(12) United States Patent
Sutton et al.

(10) Patent No.: US 10,292,519 B1
(45) Date of Patent: May 21, 2019

(54) SECURED DELIVERED MAIL REPOSITORY

(71) Applicants: Steven M. Sutton, Medina, OH (US); Nathan Williams, Medina, OH (US)

(72) Inventors: Steven M. Sutton, Medina, OH (US); Nathan Williams, Medina, OH (US)

(73) Assignee: Sutton & Williams Holdings, LLC, Fairlawn, OH (US)

( * ) Notice: Subject to any disclaimer, the term of this patent is extended or adjusted under 35 U.S.C. 154(b) by 0 days.

(21) Appl. No.: 16/128,075

(22) Filed: Sep. 11, 2018

(51) Int. Cl.
*A47G 29/12* (2006.01)
*A47G 29/14* (2006.01)
*A47G 29/122* (2006.01)

(52) U.S. Cl.
CPC ..... *A47G 29/1214* (2013.01); *A47G 29/1209* (2013.01); *A47G 29/1216* (2013.01); *A47G 2029/1226* (2013.01); *A47G 2029/144* (2013.01); *A47G 2029/145* (2013.01); *A47G 2029/148* (2013.01); *A47G 2029/149* (2013.01)

(58) Field of Classification Search
CPC ..... A47G 29/1209; A47G 29/1214; A47G 29/1216; A47G 29/124; A47G 29/141; A47G 29/20; A47G 2029/1226; A47G 2029/144; A47G 2029/145; A47G 2029/148; A47G 2029/149; E05B 73/0005; E05B 67/003
USPC ..... 232/17, 19, 45, 38, 34–36; 340/569; 248/163.1; 312/351.3; 70/63
See application file for complete search history.

(56) References Cited

U.S. PATENT DOCUMENTS 3,935,994 A 2/1976 Darvishian
4,154,393 A 5/1979 Darvishian
5,917,411 A 6/1999 Baggarly
5,954,264 A 9/1999 Keller
6,375,070 B1 * 4/2002 Snoke ..... A47G 29/141 232/20
6,483,433 B2 * 11/2002 Moskowitz ..... A47G 29/141 232/34
6,736,310 B1 5/2004 Mesol
6,879,255 B1 * 4/2005 Jezierski ..... A47G 29/1214 232/17
6,967,575 B1 * 11/2005 Dohrmann ..... A47G 29/141 220/592.01
6,987,452 B2 * 1/2006 Yang ..... A47G 29/141 232/36

(Continued)

*Primary Examiner* — William L Miller
(74) *Attorney, Agent, or Firm* — Cramer Patent & Design, PLLC; Aaron R. Cramer

(57) ABSTRACT

A secure delivered mail repository comprises a durable cuboid box having an automatically locking and unlocking door capable of being irremovably secured to a surface, emergency illumination and an anti-theft concrete and cable tether. The repository has a digital panel capable of user interface in electrical communication with a power source, a plurality of digital cameras and a plurality of speakers. The repository may be monitored from a user's internet enabled electronic device which is configured to operate in conjunction with a home security system of a user while the illumination means is configured to visually alert a first responder to an adjacent emergency. The repository facilitates the safe and secure delivery of a package mailed to the user by enabling a delivery service to deposit a package within the repository and secure the same therein.

16 Claims, 5 Drawing Sheets

(56) References Cited

U.S. PATENT DOCUMENTS 7,382,252 B2 * 6/2008 Brannon ..... G08B 7/064 232/19
8,358,199 B2 1/2013 Nesling
D714,514 S 9/2014 Pettit et al.
9,211,025 B1 * 12/2015 Elhawwashy ..... A47G 29/14
10,039,401 B1 * 8/2018 Romanucci ..... A47G 29/141
2005/0104730 A1 * 5/2005 Yang ..... A47G 29/141 340/569
2007/0181662 A1 * 8/2007 Satherblom ..... A47G 29/1207 232/45
2008/0067227 A1 * 3/2008 Poss ..... A47G 29/22 232/17
2009/0166403 A1 * 7/2009 Volpe ..... A47G 29/141 235/375
2012/0269461 A1 * 10/2012 Proctor ..... A47G 29/20 383/64
2013/0077896 A1 * 3/2013 Wiley ..... B65D 33/00 383/86.2
2013/0147626 A1 * 6/2013 Hammoud ..... G08B 13/22 340/569
2014/0075980 A1 * 3/2014 Villar ..... F24F 13/32 62/297
2015/0016665 A1 * 1/2015 Tanner ..... A47G 29/1214 382/101
2015/0021386 A1 * 1/2015 Farentinos ..... A47G 29/22 232/43.3
2015/0099508 A1 * 4/2015 Lax ..... A47G 29/1214 455/420
2015/0108209 A1 * 4/2015 Cho ..... A47G 29/1212 232/34
2015/0305538 A1 * 10/2015 Sundaresan ..... A47G 29/124 232/36
2015/0359372 A1 * 12/2015 Cho ..... A47G 29/1245 232/18
2016/0060008 A1 * 3/2016 Farentinos ..... B65D 43/16 220/211
2016/0374494 A1 * 12/2016 Geng ..... A47G 29/141 232/17
2017/0055751 A1 * 3/2017 Sundaresan ..... E05B 73/0011
2017/0286905 A1 * 10/2017 Richardson ..... G06Q 10/0832
2018/0070753 A1 * 3/2018 Eveloff ..... H04W 12/08
2018/0228311 A1 * 8/2018 Bloom ..... A47G 29/141

* cited by examiner

SECURED DELIVERED MAIL REPOSITORY

RELATED APPLICATIONS

Not applicable

FIELD OF THE INVENTION

The present invention relates generally to a secured delivered mail repository.

BACKGROUND OF THE INVENTION

In the typical business day, millions of parcels and items are delivered around the world. While computerized tracking, customer databases, and electronic scanning has greatly increased productivity and reduced mistakes, one weak link remains the final delivery point, as large packages are often simply left on front porches of unattended residences. It is simply not possible to be at home when a package is delivered anymore, as many residences often receive several packages a day.

Unfortunately, the criminal element is always present and such packages are often simply stolen. Package theft is an epidemic, and costs shippers, carriers, and customers several billion dollars annually. Similar problems result when trying to return items as well.

Accordingly, there exists a need for a means by which large and oversize parcels can be safely and securely delivered to the intended recipient with reduced opportunity for theft without the recipient being present. The development of the secured delivered mail repository fulfills this need.

SUMMARY OF THE INVENTION

To achieve the above and other objectives, the present invention provides for an unattended parcel delivery and pickup receptacle which comprises a delivery location point, a container body sitting on at least four legs, wherein the four legs vary in height, each of which are provided with an anchoring point that is utilized with an anchoring system to prevent movement or theft of the unattended parcel delivery and pickup receptacle and its contents. The four anchoring points are visible in each corner of a sealed bottom surface.

The device also comprises a main access door which is located on a front portion of the device through which one or more parcels may be placed and/or subsequently removed. The main access door is opened along a hinge via a servo mechanism.

The device also comprises a letter and newspaper slot which is located directly above the main access door and allows the unattended parcel delivery and pickup receptacle to serve conventional USPS delivery. The letter and newspaper slot allows a one-way passage of letters, magazines, and newspapers but removal of the items would occur through the main access door in order to prevent unauthorized removal of any of these items.

The device also comprises a user interface panel which is provided on the front exterior face of the device. The user interface panel is equipped with an integral camera to provide video communication with an authorized owner of the unattended parcel delivery and pickup receptacle. The user interface panel includes at least one speaker or microphone which is provided to facilitate usage with a smartphone equipped with a non-transitory storage media. At least one speaker or microphone is capable of emitting tones or pre-recorded messages when activated.

The device also comprises a display which is located on the main access door to provide visual indication of a postal address and a restraining cable which is secured to a secure anchor point to prevent theft of the device.

The integral camera may be located inside the unattended parcel delivery and pickup receptacle and allow for direct viewing of the interior of the main access door in either an opened or closed state. The integral camera may also be utilized to view and decipher a Quick Response barcode present on delivered packages for purposes of proof of delivery or pickup.

The device may also comprise four high-intensity indicator strobes each located at an upper corner of the container body. Each strobe may be used as location finding aid, package delivery notification, or an emergency aid indicator. Each corner of the container body may have a notch cut-away in a single face of a triangular prism. Each strobe may be embedded within or attached to a socket that extends minimally outward from the notch cut-away and a transparent or translucent cover covers the notch and the strobe. A transparent cover may form right angle corners to render an overall shape of the container body and cover at the upper corners as right angles.

The device may further comprise an energy source which may be selected from the group consisting of an AC power supply, a photovoltaic cell, or an internal battery bank. The device may also comprise a GPS module, a Wi-Fi antenna, and a cellular data antenna. A center mounted leg may be provided and hold the restraining cable. The leg may be secured by a plurality of fasteners. The restraining cable may forty-eight inches in length and may be made of a cut-resistant material while also being coated in a weather-resistant silicone insulation. A distal end of the restraining cable may be removably or permanently connected to the secure anchor point.

The anchoring system may be selected from the group consisting of bolts, expansion anchors, epoxy anchors, or ground stakes and may also be configured to comply with United States Postal Service and other safety requirements from a collision from a curbside or a roadside deployment.

The device may also be configured such that when the servo mechanism is not functioning—the main access door may be opened via a manual lock and a handle. The display may comprise an LED numerical display. The main access door of the device, the letter or newspaper slot, the user interface panel, and each of the at least one speaker or microphone may be located on a common face of the container body and may be oriented in a symmetrical orientation with respect to a common bisecting axial centerline. The device may be made of material selected from the group consisting of heavy-duty steel, fiberglass, reinforced carbon, or polyvinyl chloride.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
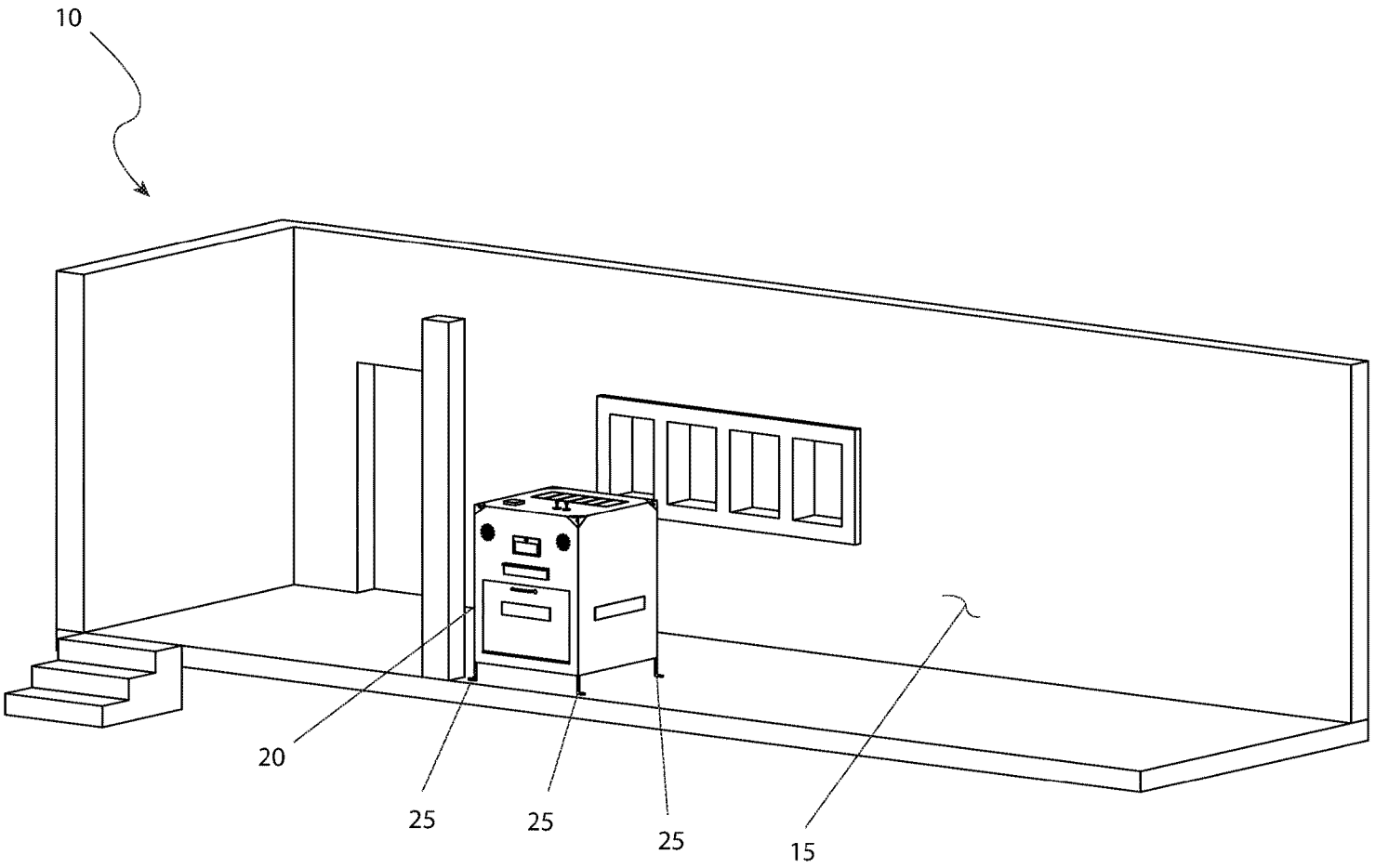
FIG. 1 is an isometric view of the receptacle 10, shown in a utilized state at a delivery location point 15, according to the preferred embodiment of the present invention.

10 receptacle
15 delivery location point
20 container body
25 leg
27 restraining cable
28 secure anchor point
30 main access door
35 hinge
40 servo mechanism
45 manual lock
50 handle
55 anchoring aperture
60 letter/newspaper slot
65 display
70 user interface panel
75 integral camera
80 speaker/microphone
85 interior camera
90 indicator strobe
91 cover
95 Global Positioning System (GPS) module
100 Wi-Fi antenna
105 cellular data antenna
107 radio frequency identification (RFID) reader
110 alternating current (AC) power supply
115 photovoltaic cell
117 radio frequency identification (RFID) tag
120 internal battery bank
125 sealed bottom surface
130 ratcheting retractable reel
135 center mounted leg
140 fastener
150 (AC) power source
155 direct current (DC) power supply
160 main bus (DC) power
165 main control processor
170 light-emitting diode (LED) driver circuit
175 hard-wired Ethernet jack
180 Wi-Fi transmitter
185 cellular data transmitter

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, an isometric view of the unattended parcel delivery and pickup receptacle 10, shown in a utilized state at a delivery location point 15, according to the preferred embodiment of the present invention is disclosed. The unattended parcel delivery and pickup receptacle 10 (herein also described as the "receptacle") 10, includes primarily of a large, secure, weatherproof enclosure for the purposes of accepting delivered parcels and other items, as well as for serving as a pickup point for said items. The delivery location point 15 is shown as a front porch of a residence for purposes of illustration. However, other locations including but not limited to: curbside locations, community pickup locations, walkways, patios, decks, parking lots and other similar locations may be utilized with the features of the receptacle 10. As such, the use of the receptacle 10 with any particular style or location of a delivery location point 15 is not intended to be a limiting factor of the present invention.

The receptacle 10 comprises a container body 20 that sits on at least four (4) legs 25. The overall size of the container body 20 is envisioned as thirty-four inches in length (34 in.), thirty-four inches (34 in.) in width, and forty inches (40 in.) in height. The legs 25 may vary in height depending on the specific area of use, such as taller legs 25 at curbside locations and shorter legs 25 at porch or deck locations. A restraining cable 27 is secured to a secure anchor point 28 for purposes of preventing theft of the entire receptacle 10. Further detail on the operation of the restraining cable 27 will be provided herein below.

Figure 2:
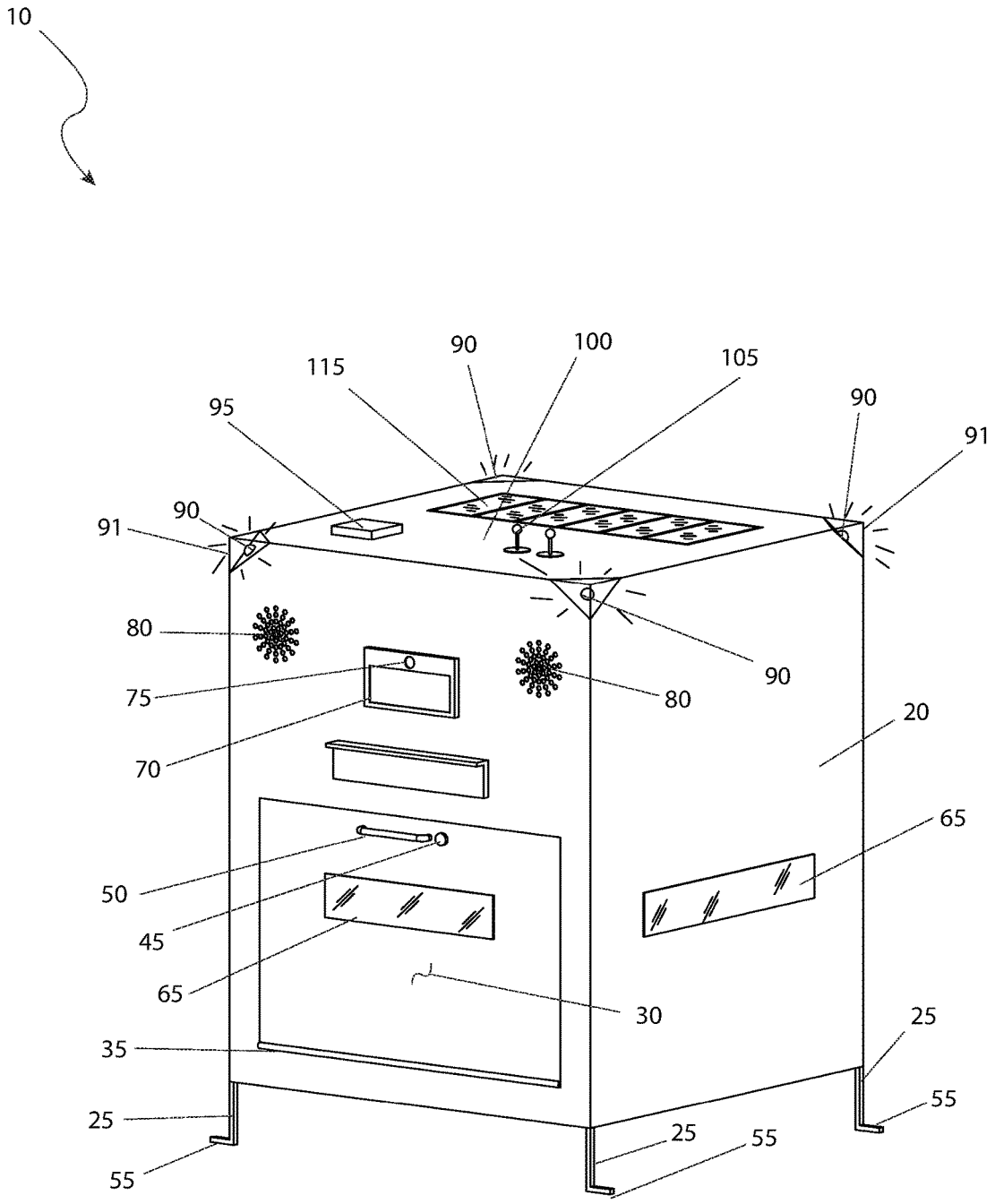
FIG. 2 is a detailed isometric view of the receptacle 10, as shown in FIG. 1, according to the preferred embodiment of the present invention.

Referring next to FIG. 2, a detailed isometric view of the receptacle 10, as shown in FIG. 1, according to the preferred embodiment of the present invention is depicted. The front of the receptacle 10 is provided with a main access door 30 through which parcels are placed and subsequently removed. It is opened along a hinge 35 via a servo mechanism 40 (not shown due to illustrative limitations) as will be described in greater detail herein below. Should the servo mechanism 40 not be functioning due to a power failure, communication linkage failure, or other anomaly, the main access door 30 may also be opened via a manual lock 45 and a handle 50. Each leg 25 is provided with an anchoring point 55 that may be utilized with an anchoring system such as bolts, expansion anchors, epoxy anchors, ground stakes, embedment or the like to prevent movement or theft of the receptacle 10 and its contents. These anchoring points 55 are envisioned to be of the breakaway style to comply with United States Postal Service (USPS) and other safety requirements in the event of a collision in the case of curbside/roadside deployment. Overall construction of the receptacle 10 is envisioned to be made of heavy-duty steel to prevent breakage and vandalism. However, other materials such as fiberglass, reinforced carbon, polyvinyl chloride (PVC), and the like could also be utilized, and as such, the material of construction of the receptacle 10 should not be a limiting factor of the present invention.

A display 65 (preferably an LED numerical display) is prominently located on the main access door 30 to provide visual indication of the respective postal address. In additional embodiments, at least two (2) more display 65 is located on another face of the container body 20. Each display 65 is easily viewed from a distance envisioned to be a minimum of fifty feet (50 ft.) and is inherently illuminated to facilitate usage at night. Other displays 65 may be located on sides of the receptacle 10 as well as dictated by placement requirements.

A letter/newspaper slot 60 is located directly above the main access door 30 and allows the receptacle 10 to serve the purposes of conventional USPS delivery. The letter/newspaper slot 60 is of a small nature so as to allow the one-way passage of letters, magazines, and newspapers but removal of said items would occur through the main access door 30 as governed by the user in order to prevent unauthorized removal. A user interface panel 70, similar in design and usage to a weatherproof tablet computer is provided on the front exterior face of the receptacle 10. The user interface panel 70 is equipped with an integral camera 75 to provide video communication with an authorized owner/user of the receptacle 10. In the event two-way voice communication is required with any delivery personnel, at least one (1) speaker/microphone 80 is provided to facilitate usage with a smart phone or similar device equipped with an appropriate application (app). It is appreciated that in at least one (1) embodiment, the main access door 30, the letter/newspaper slot 60, the user interface panel 70, and each speaker/microphone 80 are located on a common face of the container body 20 and oriented in a symmetrical orientation with respect to a common bisecting axial centerline. The speaker/microphone 80 is selectively capable of emitting tones or pre-recorded messages when activated.

An interior camera 85 (not shown in this figure due to illustrative limitations) is located inside the receptacle 10 and allows for direct viewing of the interior of the main access door 30 in either an opened or closed state. The interior camera 85 (not shown in this figure due to illustrative limitations) may also be utilized to view/decipher a Quick Response (QR) barcode present on delivered packages for purposes of proof of delivery or pickup.

Figure 5:
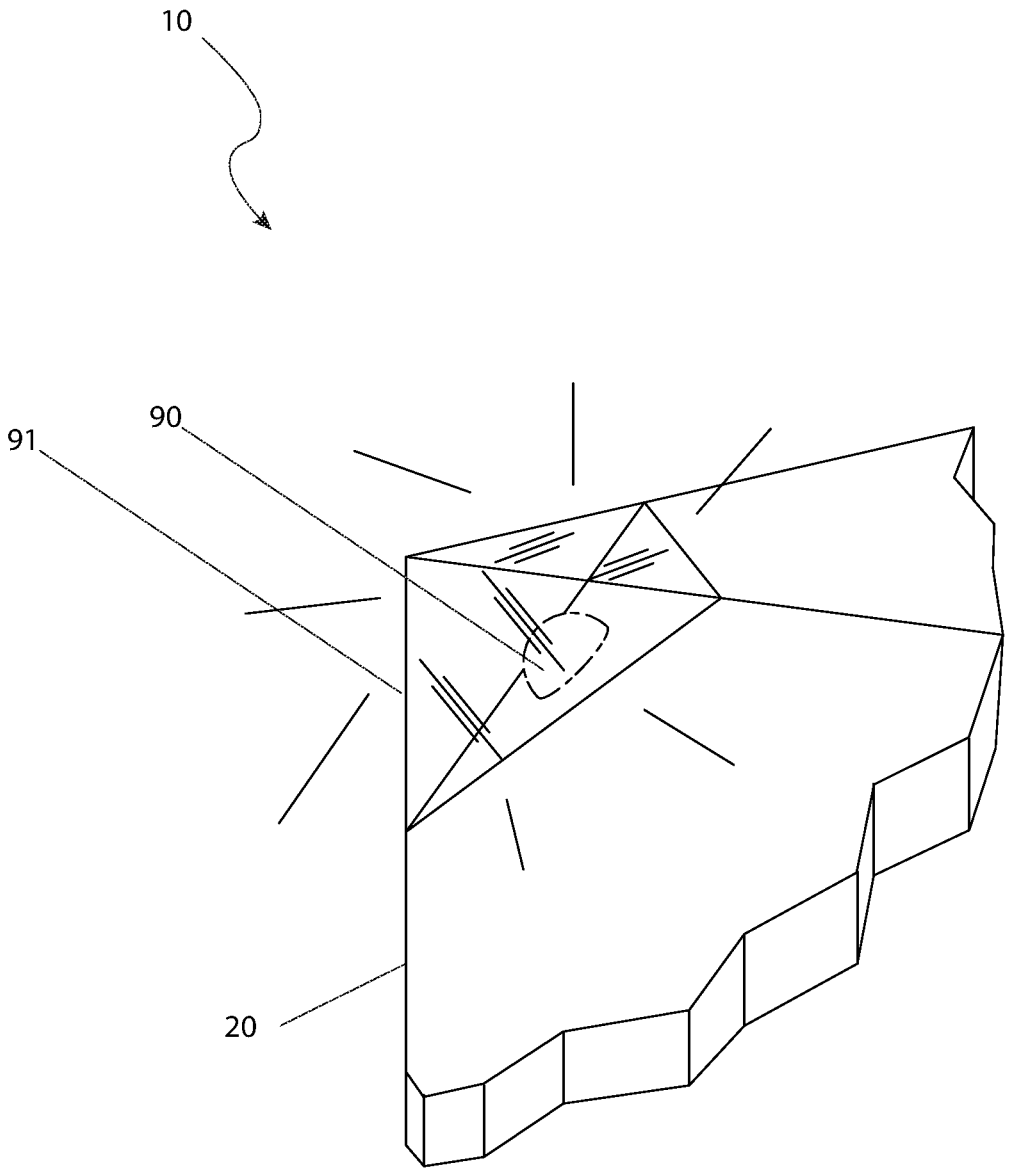

There are four (4) high-intensity indicator strobes 90 each located at an upper corner of the container body 20. The high intensity indicator strobes 90 may be used in a wide variety of circumstances including but not limited to: location finding aids (allows high intensity indicator strobes 90 to be flashed when delivery/pickup service is present in a neighborhood, but experiencing difficulty in locating proper location), package delivery notification (can flash periodically to indicate parcel delivery to a user returning home, an emergency aid indicator (in the event of an emergency the property, the unit could strobe the indicator strobes 90 upon command from a home automation system, an alarm system, or a command from the associated smart phone app), or similar instance requiring visual attention. The activation and operation of the strobes 90 is selective and can also vary in intensity or merely illuminate in a typical fashion. Referring now to FIG. 5, a close-up view of an individual strobe 90 and cover 91 on the container body 20, is shown. Each corner of the container body 20 has a notch cut-away therefrom, particularly in a shape of a single face of a triangular prism. Each strobe 90 is embedded within or attached to a socket that extends minimally outward from the cut-face. A transparent or translucent cover 91 covers this notch and the strobe 90. In a preferred embodiment, the transparent covers 91 form right angle corners to render the overall shape of the container body 20 and cover 91 at the upper corners as right angles.

The receptacle 10 is equipped with a GPS module 95, a Wi-Fi antenna 100, and a cellular data antenna 105, all of which whose functionality will be described in greater detail herein below. The receptacle 10 may be powered by multiple energy sources. An AC power supply 110 (not shown due to illustrative limitations) provides power through a surface-mounted or underground raceway. A photovoltaic cell 115 can be used to charge an internal battery bank 120 (not shown due to illustrative limitations) to serve as primary or backup power as well. The internal battery bank 120 (not shown due to illustrative limitations) is envisioned to provide power for up to two (2) days before recharging is required.

Figure 3:
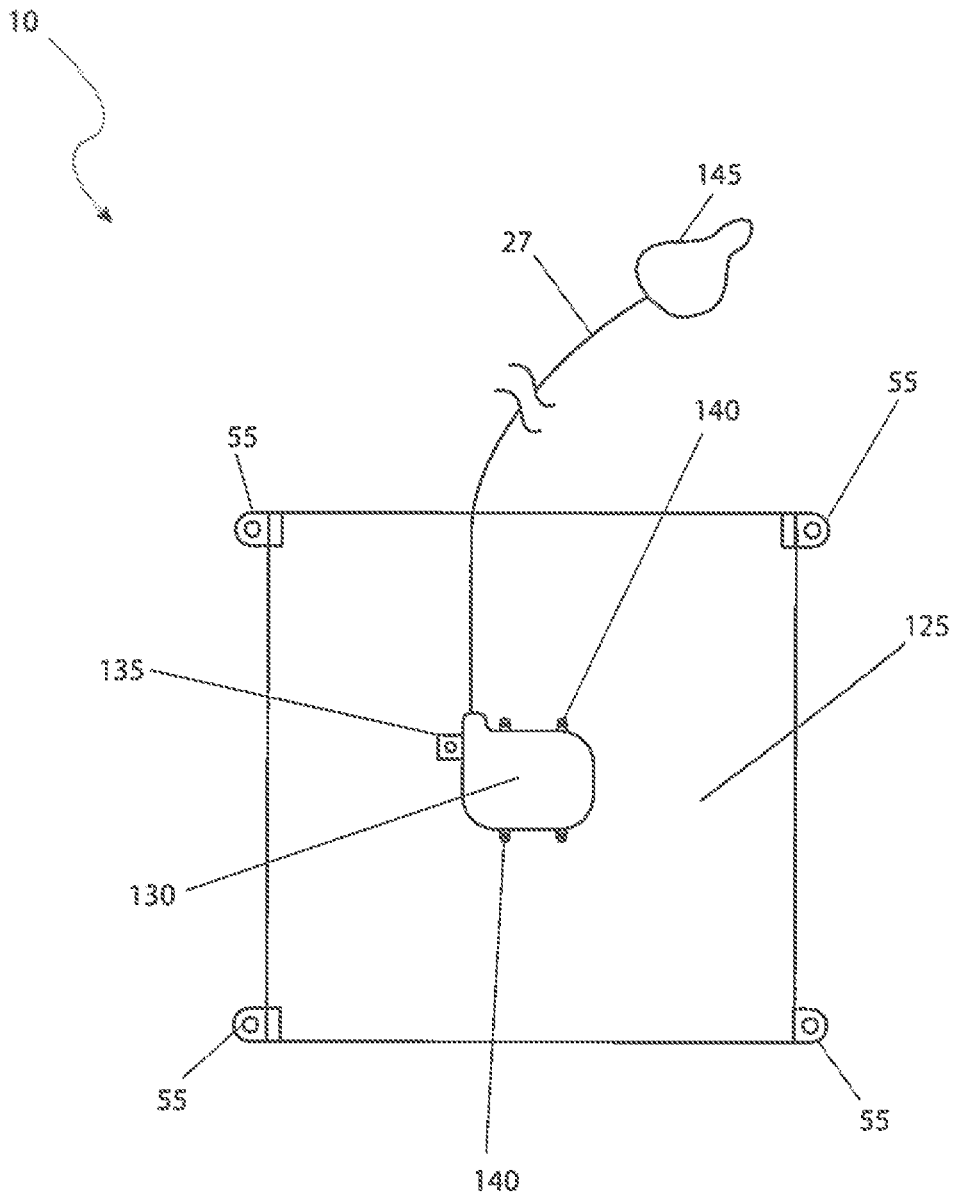
FIG. 3 is a bottom view of the receptacle 10, according to the preferred embodiment of the present invention.

Referring now to FIG. 3, a bottom view of the receptacle 10, according to the preferred embodiment of the present invention is shown. The four (4) anchoring points 55 are visible in each corner of the sealed bottom surface 125. A center mounted leg 135 holds the restraining cable 27 and is secured by a center mounted leg 135 as well as fasteners 140. The restraining cable 27 is approximately forty-eight inches (48 in.) in total length and is envisioned to be cut-resistant and coated in a weather-resistant silicone insulation. The distal end of the restraining cable 27 is removably or permanently connected to a secure anchor point 28, which is envisioned to be a stationary object, such as a mass of concrete, sunken post, structural anchor, concrete mounted anchor or the like. In a preferred embedment, the secure anchor point 28 is a teardrop-shaped mass of concrete. A locking mechanism of sufficient strength may be utilized to allow for maintenance, servicing or the like as required.

Figure 4:
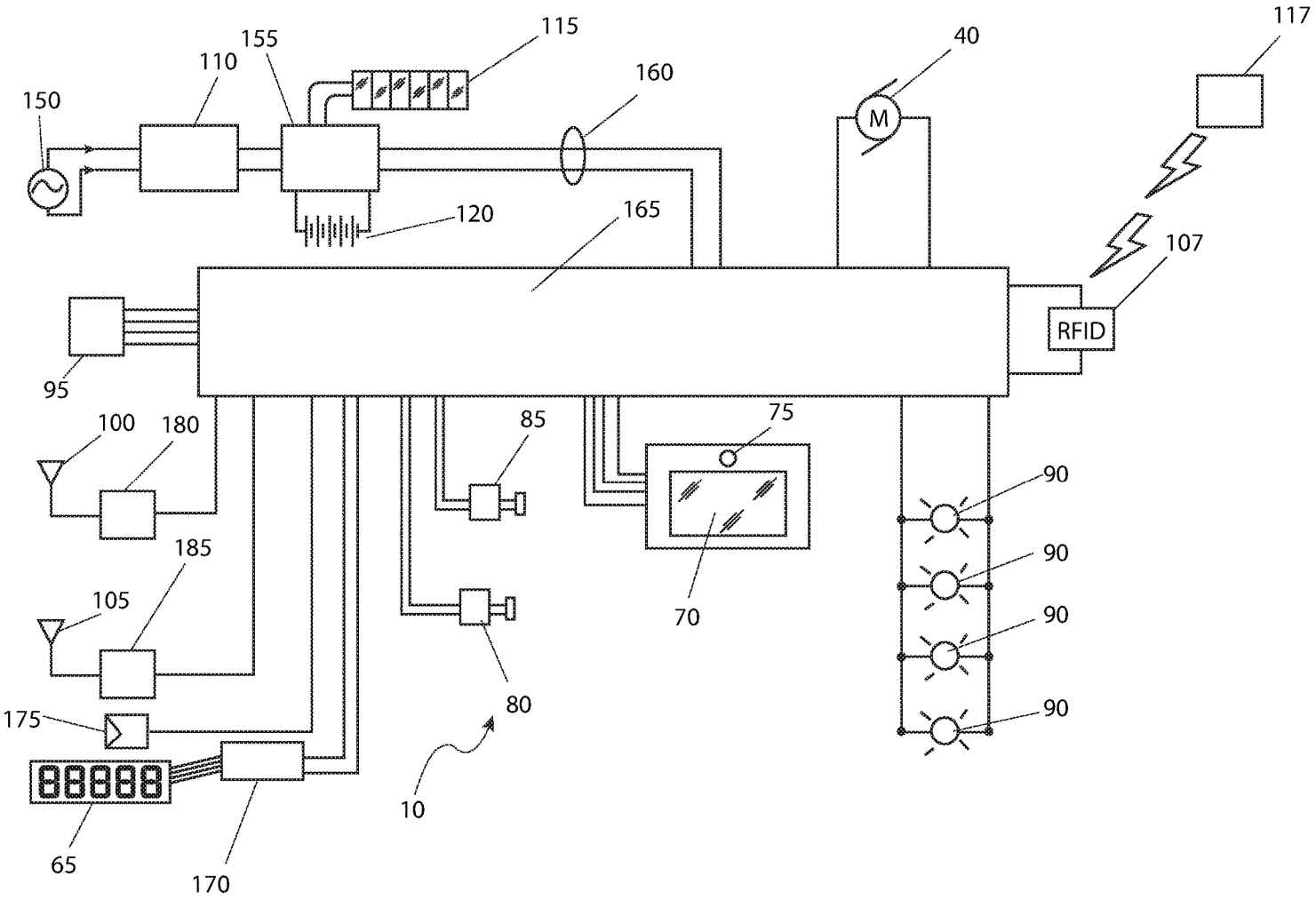
FIG. 4 is an electrical block diagram of the receptacle 10, according to the preferred embodiment of the present invention; and, FIG. 5 is a close-up view of an individual indicator strobe 90 and cover 91 orientation and location on the container body 20, according to a preferred embodiment of the present invention.

Referring to FIG. 4, an electrical block diagram of the receptacle 10, according to the preferred embodiment of the present invention is disclosed. An AC power source 150 feeds the AC power supply 110 which produces DC current and feeds it to a DC power supply 155. The DC power supply 155 also receives power from the photovoltaic cell 115 and passes the resultant power to the internal battery bank 120 which is kept in a charged state upon receipt of power from either the AC power supply 110 or the photovoltaic cell 115. Main bus DC power 160, from either the internal battery bank 120 or converted from the AC power supply 110 is then delivered to a main control processor 165 such as a Single Board Computer (SBC) to provided internal control of the receptacle 10. Location information from the GPS module 95 services as an input. An output signal is generated to operate the servo mechanism 40 to open, close, and/or lock the main access door 30 (as shown in FIG. 2). An independent output signal is generated to operate, flash, or strobe the four (4) indicator strobes 90 at varying levels of illumination brightness. Input/output parameters are passed to and from the user interface panel 70 along with video signals from the integral camera 75 and audio signals from the speaker/microphone 80. Input signals from the interior camera 85 are received as well. An output signal is generated by the main bus DC power 160 and conditioned by an LED driver circuit 170 to illuminate the display 65 to represent the physical address of the location where the receptacle 10 is utilized. Subsequent changing of the address displayed would be controlled by manipulation of the user interface panel 70. Remote communication with the receptacle 10 would generally be through a hard-wired Ethernet jack 175 (routed along with incoming power connections), through a Wi-Fi transmitter 180 and cellular data transmitter 185 to connect to a Wi-Fi router located nearby, or through a primary or secondary (backup) via a cellular data transmitter 185 and the cellular data antenna 105 in locations where local internet service is not available.

For packages that are too large or too bulky to properly store within the receptacle 10, at least one (1) RFID tag 117 can be placed on the package. Each RFID tag 117 can be located on the container body 20 or more preferably contained within the container body 20 and accessible through the main access door 30. A radio frequency identification (RFID) reader 107 is housed within the receptacle 10, preferably adjacent to or integral with the main control processor 165 and in wireless communication with each individual RFID tag 117. In instances where the delivered package is too large to fit in the receptacle 10, the delivery person accesses an individual RFID tag 117 and attaches it to the package via an attachment means. Such attachment means is typically adhesive bonding, but other attachment means can be envisioned. The RFID reader 107 will then transmit a distress signal when any of the RFID tags 117 exceeds a pre-determined distance from the RFID reader 107. The main control processor 165 receives the distress signal from the RFID reader 107 and would activate an alarm, which can be tied to the strobes 90, the speaker/microphone 80, the Wi-Fi transmitter 180, and/or the cellular data transmitter 185.

2. Operation of the Preferred Embodiment

The preferred embodiment of the present invention can be utilized by the common user in a simple and effortless manner with little or no training. It is envisioned that the receptacle 10 would be constructed in general accordance with FIG. 1 through FIG. 4. The user would procure the receptacle 10 while paying attention to various electrical and electronic interfaces and overall leg length. It would then be installed in the following manner: the receptacle 10 would be placed in the general location of use; the anchoring point 55 of each legs 25 would be secured using appropriated fastening methods, the restraining cable 27 would be fastened to the secure anchor point 28 in a secure and restrained manner; electrical power hookup to the AC power supply 110 would be made; and communication cable hookup would be made to the hard wired Ethernet jack 175 (if required).

After procurement and prior to utilization, the receptacle 10 would be prepared in the following manner: the associated app would be installed on a respective smart phone or tablet computer; address parameters would be entered into the main control processor 165 and a login to a central control database would be initiated.

During utilization of the receptacle 10, the following procedure would be initiated: as a delivery or pickup person approaches the receptacle 10, an introduction through the user interface panel 70 and/or speaker/microphone 80 would be made; acceptance and delivery would be made by opening the main access door 30 through use of the servo mechanism 40 either controlled remotely by the owner through the smart phone app, or locally by the keying in of an authorized user number into the user interface panel 70; the main access door 30 then opens for acceptance or removal of the parcel; a similar approach (without local access) via the user interface panel 70 would be utilized for a remote delivery drone; upon verification of delivery or removal, the servo mechanism 40 would be energized to close the main access door 30; QR and/or package would be verified via the interior camera 85; notification to shipper and recipient would be made via existing internet communication protocols; in the event of an unplanned delivery, the delivery or pickup person could contact the owner directly via the user interface panel 70; owner could then elect to open the main access door 30 remotely, or engage in voice or video communication with the carrier representative; self-docking drones can return goods to manufacturers through owner chosen location through real-time unit location reporting via GPS and cellular data (AGPS function) automation; and the indicator strobes 90 on the receptacle 10 could be triggered remotely as described above to alert to abnormal or emergency situations. In the event of a flood or other natural disaster, the receptacle 10 could securely store valuables due to the secure and waterproof nature of the enclosure 20.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An unattended parcel delivery and pickup receptacle, comprising:

a delivery location point;

a container body sitting on at least four legs, wherein said at least four legs vary in height, each of said at least four legs are provided with an anchoring point that is utilized with an anchoring system to prevent movement or theft of said unattended parcel delivery and pickup receptacle and its contents, said four anchoring points are visible in each corner of a sealed bottom surface;

a main access door provided on a front portion of said unattended parcel delivery and pickup receptacle through which one or more parcels placed and subsequently removed, said main access door is opened along a hinge via a servo mechanism;

a letter and newspaper slot located directly above said main access door and allows said unattended parcel delivery and pickup receptacle to serve conventional USPS delivery, said letter and newspaper slot allows a one-way passage of letters, magazines, and newspapers but removal of said items would occur through said main access door in order to prevent unauthorized removal;

a user interface panel provided on said front exterior face of said unattended parcel delivery and pickup receptacle, said user interface panel is equipped with an integral camera to provide video communication with an authorized owner of said unattended parcel delivery and pickup receptacle, said user interface panel includes at least one speaker or microphone provided to facilitate usage with a smartphone equipped with a non-transitory storage media, said at least one speaker or microphone emitting tones or pre-recorded messages when activated;

a high-intensity indicator strobe each located at an upper corner of said container body;

a display located on said main access door to provide visual indication of a postal address; and, a restraining cable secured to a secure anchor point to prevent theft of said unattended parcel delivery and pickup receptacle;

wherein said high intensity indicator strobes are used as location finding aids, package delivery notification, or an emergency aid indicator;

wherein said anchoring points are configured to break upon impact from a collision with a motor vehicle; and, wherein each upper corner of said container body comprises a notch cut-away in a single face of a triangular prism.

2. The unattended parcel delivery and pickup receptacle according to claim 1, wherein an integral camera located inside said unattended parcel delivery and pickup receptacle and allows for direct viewing of said interior of said main access door in either an opened or closed state.

3. The unattended parcel delivery and pickup receptacle according to claim 2, wherein said integral camera is utilized to view and decipher a Quick Response barcode present on delivered packages for purposes of proof of delivery or pickup.

4. The unattended parcel delivery and pickup receptacle according to claim 1, wherein each strobe is embedded within or attached to a socket that extends minimally outward from said notch cut-away and a transparent or translucent cover covers said notch and said strobe.

5. The unattended parcel delivery and pickup receptacle according to claim 4, wherein said transparent or translucent covers form right angle corners to render an overall shape of said container body and cover at said upper corners as right angles.

6. The unattended parcel delivery and pickup receptacle according to claim 1, further comprising an energy source selected from said group consisting of an AC power supply, a photovoltaic cell, or an internal battery bank.

7. The unattended parcel delivery and pickup receptacle according to claim 1, further comprising a GPS module, a Wi-Fi antenna, and a cellular data antenna.

8. The unattended parcel delivery and pickup receptacle according to claim 1, further comprising a center mounted leg holds said restraining cable and is secured by a plurality of fasteners to said bottom surface.

9. The unattended parcel delivery and pickup receptacle according to claim 8, wherein said restraining cable is 48 inches in total length.

10. The unattended parcel delivery and pickup receptacle according to claim 8, wherein said restraining cable is envisioned to be cut-resistant and coated in a weather-resistant silicone insulation.

11. The unattended parcel delivery and pickup receptacle according to claim 10, wherein a distal end of said restraining cable is removably or permanently connected to said secure anchor point.

12. The unattended parcel delivery and pickup receptacle according to claim 1, wherein said anchoring system is selected from said group consisting of bolts, expansion anchors, epoxy anchors, or ground stakes.

13. The unattended parcel delivery and pickup receptacle according to claim 1, wherein said servo mechanism is not functioning and said main access door is opened via a manual lock and a handle.

14. The unattended parcel delivery and pickup receptacle according to claim 1, wherein said display is an LED numerical display.

15. The unattended parcel delivery and pickup receptacle according to claim 1, wherein said main access door, said letter or newspaper slot, said user interface panel, and each of said at least one speaker or microphone are located on a common face of said container body and are oriented in a symmetrical orientation with respect to a common bisecting axial centerline.

16. The unattended parcel delivery and pickup receptacle according to claim 1, wherein said unattended parcel delivery and pickup receptacle is made of material selected from said group consisting of heavy-duty steel, fiberglass, reinforced carbon, or polyvinyl chloride.

* * * * *